United States Patent [19]

Gdulla

[11] 4,276,877

[45] Jul. 7, 1981

[54] RESPIRATORY METHOD AND APPARATUS

[75] Inventor: Manfred Gdulla, Lübeck, Fed. Rep. of Germany

[73] Assignee: Drägerwerk Aktiengesellschaft, Lübeck, Fed. Rep. of Germany

[21] Appl. No.: 104,881

[22] Filed: Dec. 18, 1979

[30] Foreign Application Priority Data

Mar. 5, 1979 [DE] Fed. Rep. of Germany ..... 2908528

[51] Int. Cl.[3] ..... A62B 7/04

[52] U.S. Cl. ..... 128/200.27; 128/201.28; 128/204.26

[58] Field of Search ..... 128/201.28, 201.23, 128/204.26, 205.25, 206.24, 206.15, 206.28, 207.12, 206.21, 200.27, 201.15, 201.24

[56] References Cited

U.S. PATENT DOCUMENTS 2,381,568 8/1945 Booharin ..... 128/207.12 X 2,830,584 4/1958 Hollmann et al. ..... 128/207.12

3,716,053 2/1973 Almovist et al. ..... 128/204.26 X

*Primary Examiner*—Henry J. Recla

*Attorney, Agent, or Firm*—Max Fogiel

[57] ABSTRACT

A method of supplying respiratory air to a user, and a breathing apparatus for this purpose. An inner and an outer mask are provided, the inner mask communicating only with the respiratory passages of the user and the outer mask covering the face of the user. Superatmospheric pressure is maintained in the outer mask and the outer mask is communicated with the interior of the inner mask during suction created in the inner mask as a result of inhalation. Air flowing from the outer mask into the inner mask is replenished from an extraneous air supply. When the exhalation cycle begins, the communication between the inner and outer mask is interrupted and exhaled air is vented from the inner mask directly to the ambient atmosphere.

6 Claims, 2 Drawing Figures

FIG. 1
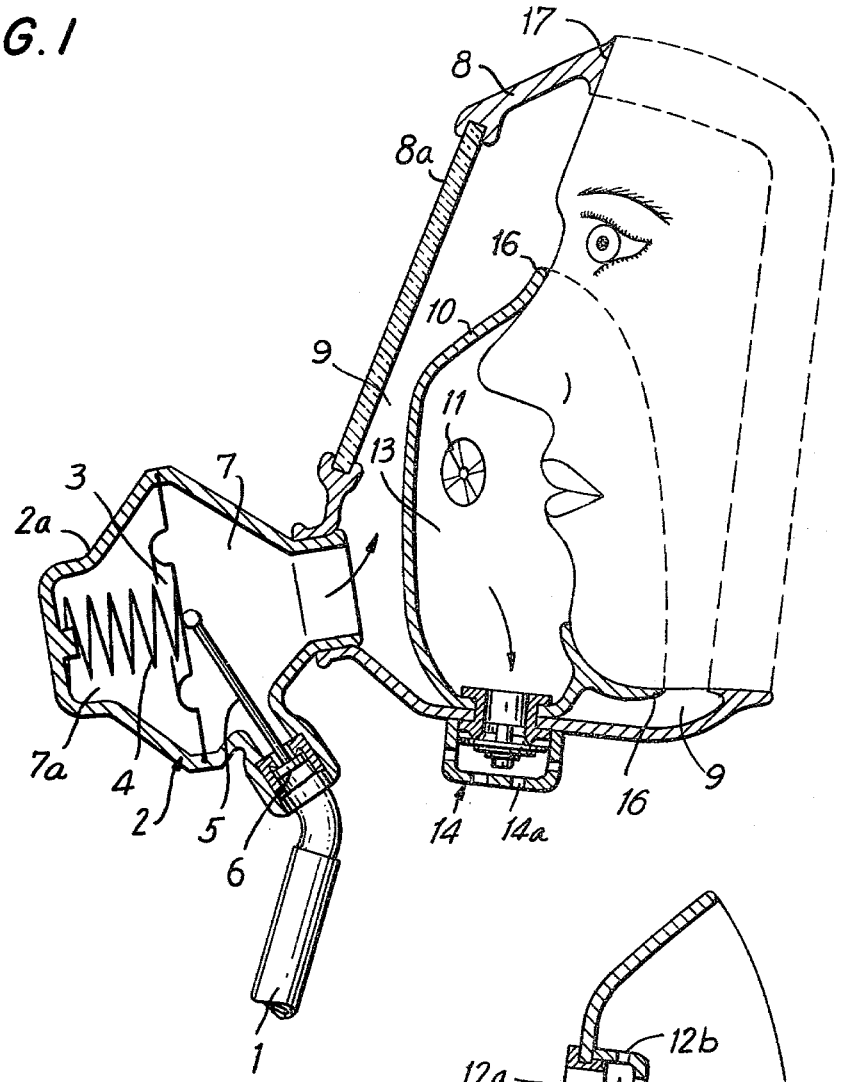
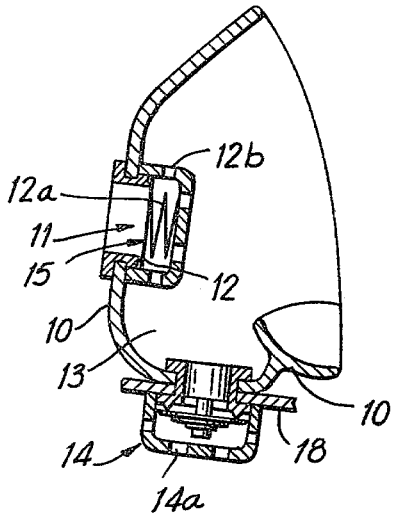
FIG. 2

RESPIRATORY METHOD AND APPARATUS

BACKGROUND OF THE INVENTION

This invention relates to human respiration in general.

More particularly, the invention relates to a method of supplying the external respiratory organs with breathing air, and to a respiratory apparatus for carrying out this method.

During inhalation a suction or partial vacuum is created in the outer respiratory passages of the human body, and conversely pressure is created in these passages during exhalation. When it is necessary for a human being to wear respiratory apparatus, for example in space, in contaminated atmospheres, in smoke-filled rooms and similar applications, this alternating pressure cycle during breathing is transmitted to the respiratory apparatus being used and is employed to control the functioning of the apparatus. What this amounts to, in effect, is an extension of the natural breathing passages by the respiratory apparatus without, however, interfering in any way with the normal physiology of breathing. This system of artificially supplying air for respiration is thus in keeping with the normal functioning of the human body and would be the optimal solution if the additional resistance offered to breathing by the use of the apparatus (i.e. the pressure fluctuations for inhalation and exhalation) and the increase in the dead air spaces occasioned by the use of the apparatus, could be maintained sufficiently low so as to avoid making breathing too difficult.

This type of breathing equipment presents, however, certain problems which have heretofore not been overcome.

A particular problem is the question how to tightly connect the breathing apparatus to the external respiratory organs of the user. All such equipment utilizes a mask of some type which must tightly engage the face of the user circumambiently of the external respiratory organs, i.e. the mouth and the nose. When the user inhales this creates a partial vacuum in the mask, which means that the pressure in the mask is sub-atmospheric with reference to the ambient atmosphere. Due to the thus existing pressure gradient in direction inwardly of the mask, ambient air tends to leak into the interior of the mask and to reach the respiratory passages of the user. Depending upon the problems involved in the ambient atmosphere such leakage may be merely annoying if it is kept to a minimum or it may actually be dangerous or possibly even fatal.

It is, of course, already known that if super-atmospheric pressure is maintained in the mask at all times, i.e. not only during exhalation but also during inhalation, this will prevent the entry of ambient air at atmospheric pressure. However, it will also offer considerable additional resistance to the breathing function which makes breathing substantially more difficult than under ordinary circumstances, a factor which will be readily understood when it is kept in mind that normal breathing creates during the inhalation phase a slight underpressure (i.e. pressure below atmospheric pressure) in the outer respiratory passages and a slight overpressure (pressure above atmospheric pressure) during the exhalation phase.

A lung-controlled respiratory apparatus is known having a mask which engages the face of the user with a circumferentially standing seal and further having a breath-controlled dosing valve for the breathing air which is applied under pressure. The dosing valve has a control diaphragm the outer side of which is subject to ambient pressure and the inner side of which is subject to the pressure prevailing at interior of the breathing mask. The dosing valve is opened as a result of inhalation, for which purpose the inner side of the control diaphragm and the valve body are connected via tilt lever. The arms of the tilt lever are so dimensioned that the dosing valve is closed when the super-atmospheric pressure desired for the interior of the mask has been reached. The mask also has a vent valve which opens only when the super-atmospheric pressure desired in the interior of the mask is exceeded. This means that when the user exhales he must first overcome the interior pressure in the mask, i.e. he must exhale against the super-atmospheric pressure within the mask. His total exhalation pressure therefore is a product of the super-atmospheric pressure in the mask plus the additional pressure required to reach the operating pressure at which the vent valve will open.

For inhalation the breathing valve opens in response to the reduced super-atmospheric pressure which develops in the interior of the mask during the inhalation phase. During the entire inhalation phase there remains an over pressure in the interior of the mask which is sufficient to create a pressure gradient in direction outwardly towards the ambient atmosphere i.e. to prevent the leakage of ambient atmosphere into the mask of the device. This construction, disclosed in German Published Application OS No. 2,406,307, thus has the above-described desired advantage of preventing the infiltration of ambient air into the mask at all times. However, it does make breathing more difficult for the user, in the sense that the user must at least during exhalation overcome pressures greater than those encountered during normal breathing, so that the use of such a device leads to a certain amount of discomfort.

SUMMARY OF THE INVENTION

Accordingly, it is a general object of this invention to avoid the disadvantages outlined herein before.

A more particular object of the invention is to provide an improved method of supplying breathing air to the respiratory passages of a user employing a respiratory apparatus.

An additional object of the invention is to provide such a method which prevents the infiltration of ambient air into the apparatus but does not—or not appreciably—add to the breathing effort required by the user.

A concomitant object is to provide an apparatus for carrying out the invention.

Pursuant to the above objects and to still others which will become apparent as the description of the invention proceeds, one aspect of the invention resides in a method of supplying breathing air to a user wearing a breathing apparatus having a mask which forms a larger outer chamber surrounding the user's face and a smaller inner chamber within the outer chamber which surrounds only the user's external respiratory organs. Briefly stated, this method may comprise the steps of normally maintaining the outer chamber at super-atmospheric pressure; establishing communication between the chambers in response to suction created in the inner chamber due to inhaling by the user, so that the inhaled air of the inner chamber is replenished by air flowing from the outer chamber into the inner chamber, with a concomitant pressure drop in the outer chamber; admitting fresh air at super-atmospheric pressure into the outer chamber in response to the pressure drop; interrupting communication between the chambers in response to pressure created in the inner chamber due to exhaling by the user; and venting the exhaled air from the inner chamber to the ambient atmosphere.

An apparatus for carrying out this method may, briefly stated, comprise wall means forming a larger outer mask dimensioned to fit over the face of the user and a smaller inner mask dimensioned to cover only the external respiratory organs of the user and to subdivide the space within the outer mask into an inner chamber adapted to communicate with the external respiratory organs, and an outer chamber about the inner chamber and adapted to be at super-atmospheric pressure. Control means may be provided, operative for communicating the chambers with one another in response to suction created by inhaling so that the inhaled air from the inner chamber is replenished by air entering from the outer chamber and for interrupting such communication in response to pressure created in the inner chamber by exhaling. The main valve means serves for admitting air into the outer chamber in response to a pressure drop in the outer chamber which results upon communication of the outer chamber with the inner chamber, and venting means vents exhaled air from the inner chamber to the ambient atmosphere.

A method and an apparatus according to the present invention offer the user the essential advantage of being protected against the undesired entry of contaminated ambient air into the mask and from there to the respiratory passages, while at the same time assuring that no increased strain is placed upon the physiological breathing apparatus of the user, i.e. making certain that the user does not find breathing more difficult than if he were not wearing the apparatus.

The invention will hereafter be described with respect to an exemplary embodiment of an apparatus for carrying it into effect. It should be understood, however, that this is in fact by way of example only and is not to be considered limiting in any sense, inasmuch as the actual scope of the invention is defined exclusively by the appended claims.

BRIEF DESCRIPTION OF THE DRAWINGS

FIG. 1 is a sectional elevation, showing an apparatus according to the invention installed on the face of a user but omitting illustration of the air supply; and FIG. 2 is an enlarged sectioned detail view of the apparatus in FIG. 1.

DESCRIPTION OF THE PREFERRED EMBODIMENTS

The invention will hereafter be described with reference to the exemplary apparatus shown in FIGS. 1 and 2, and as the description of the apparatus proceeds the description of the method will be integrated therewith. It should be noted, incidentally, that in the drawings the air supply which supplies air at super-atmospheric pressure to the apparatus has not been illustrated because this is known per se and does not form a part of the present invention.

With this in mind it will be seen that reference numeral 1 identifies an inlet tube or hose through which air at super-atmospheric pressure from the not-illustrated air supply is furnished to the apparatus, and more particularly, to the pressure-controlled demand valve 2 of the apparatus. The pressure at which such air is supplied via the tube 1 is usually between 3 and 10 bar. Of course, the hose or tube 1 can be connected with the pressure reducing device of a compressed-air bottle or container, or with any other type of compressed-air supplying device known in this art.

Installed in a housing 2*a* of the demand valve 2 is a diaphragm 3 (known per se) the outer circumferential edge of which is secured to the housing so as to subdivide the interior thereof into two compartments 7 and 7*a*. The compartment 7*a* communicates in the usual manner (not illustrated) with the ambient atmosphere and contains a biasing spring 4 which reacts against a portion of the wall 2*a* and the diaphragm 3, respectively. Also installed in the housing 2*a*, so as to communicate with the compartment 7 of the same, is the actual air-admitting valve 6 of the demand valve 2, i.e. the valve to which compressed air is supplied by the tube 1. A control arm 5 is connected with the valve member of the valve 6 and rests with its free end against the inner side of the diaphragm 3 so that, when the diaphragm 3 is deflected in direction inwardly of the compartment 7, such motion is transmitted to the arm 5 which causes the valve 6 to open in response thereto, whereupon air flows from the tube 1 into the compartment 7.

The demand valve 2 is connected to the outer mask 8 of the device, i.e. the mask which surrounds the entire face of the user and engages the face along a circumferentially extending sealing edge 17. The space within the mask 8 is, however, subdivided into two chambers 9 and 13, respectively, by an inner mask 10 which is so dimensioned that it surrounds and communicates with only the external respiratory organs of a user, i.e. it surrounds the nose and the mouth of the user.

The outer chamber 9 is in open communication with the compartment 7 so that the pressure prevailing in the compartment 7 is also the pressure which will prevail in the compartment 9.

The inner compartment 13 can communicate with the outer compartment 9 via two control valves 11 (only one shown) which are installed in the wall forming the mask 10. As in FIG. 2, the valves 11 have a valve member 12 which is pressed against its seat by a biasing spring 12*a* and their air passage communicate with the chamber 13 within the mask 10 via openings 12*b*. Also installed in the device, and more particularly connected both with the mask 10 and the outer mask 8 is a venting valve 14 which communicates with the chamber 13 and, via passages 14*a* with the ambient atmosphere. The mask 10 has a circumferentially extending edge portion 16 which tapers to edge 16 of the edge portion, being so shaped that it can tightly engage the face of the user so the super-atmospheric pressure present in the chamber 9—as will be subsequently described—aids in pressing the edge 16 against the face of the user to provide even further security against the undesired entry of ambient air and access to the respiratory passages of the user.

The material for the masks 8 and 10 may be one of the synthetic plastic materials used in the prior art, for example PVC, PET or PUT. Such materials are already widely used for this type of equipment and therefore require no more detailed discussion. The mask 8 is provided with a viewing port closed by a transparent plate 8*a*, of e.g. glass or a synthetic plastic material have the requisite characteristics and also known per se in this art.

When air passes via tube 1 and valve 6 into the compartment 7, the compartment 7 and hence the chamber 9 are at super-atmospheric pressure. The desired degree of super-atmospheric pressure, e.g. 4 mbar is a function of the operation of the valves 11. In other words, the level of super-atmospheric pressure which develops in the compartment 7 and hence in the chamber 9 is a function of the biasing force exerted by the spring 4. This super-atmospheric pressure of course is present throughout the chamber 9, including the area where the sealing lip 17 of the mask 8 engages the face of the user. This super-atmospheric pressure of e.g. 4 mbar thus is the overpressure which prevents the entry of atmospheric air into the system. If there are any leaks along the seal established by the sealing lip 17 or elsewhere in the masks, air can flow out of the system to the ambient atmosphere, but it cannot enter from the ambient atmosphere into the system. This is the opposite of what would happen in a conventional respiratory apparatus in which sub-atmospheric pressure is present throughout the entire mask during inhalation.

To prevent the valves 11 from opening at this stage and permitting the development of the same super-atmospheric pressure in the chamber 13 which is present in the chamber 9 at this time, the valves 11 have biasing springs 12*a* which urge the valve members 12 against their valve seats with a force which is at least equal to the force of the super-atmospheric pressure of e.g. 4 mbar times the surface area 15 of the valve members 12 and which tends to lift the valve members 12 off their valve seats. It is, however, currently preferred that the biasing force exerted by the springs 12*a* be somewhat greater than the equilibrium force required to maintain the valve members 12 in engagement with their valve seats. The vent valve 14 is of the type which is conventionally used in such breathing apparatus and which has very little resistance to opening, i.e. opens even when a very slight super-atmospheric pressure develops in the chamber 13 as a result of the exhalation of air by the user. The operation of the apparatus and method according to the present invention will be understood from what has been stated herebefore. It is clear that when the user inhales the development of even a very slight sub-atmospheric pressure in the chamber 13 causes the valves 11 to open so that air flows from the chamber 9 through the valves 11 into the chamber 13 and hence to the respiratory passages of the user. This results in a pressure drop in the chamber 9 and consequently in the compartment 7 which communicates with the chamber 9; since this pressure drop reduces the pressure in the compartment 7, the spring 4 can now flex the diaphragm 3 in direction inwardly of the compartment 7, displacing the arm 5 to the right (in FIG. 1) and thereby causing the valve 6 to open so that additional air at super-atmospheric pressure is admitted into the compartment 7. The valve 6 remains in open condition until the air required for the inhalation phase has been supplied, i.e. until inhalation stops and thus the equilibrium condition is re-established. During all this time, the super-atmospheric pressure is maintained in the compartment 7 as well as in the chamber 9 which freely and openly communicates therewith, so that there is no danger that ambient air can enter the system. The only area in which sub-atmospheric pressure temporarily develops during inhalation is in the chamber 13 within the mask 10.

When the exhalation phase begins, positive pressure develops in the chamber 13, causing immediate closing of the valves 11, so that the compartments 9 and 13 are now again cut off from one another. The valve 14 responds to the developing over pressure by opening so that the exhaled air can be vented directly to the atmosphere without the user having to breathe out against the super-atmospheric pressure which exists in the chamber 9.

It is clear, therefore, that the invention achieves its intended purposes, in that it maintains the advantage of sealing the system against the entry of ambient air by providing super-atmospheric pressure in the chamber 9, but completely eliminates any additional strain on the physiological breathing apparatus of the user due to the fact that the user does not have to exhale against the existing super-atmospheric pressure in the chamber 9, but only exhales into the chamber 13 which is directly and immediately vented to the ambient atmosphere.

Although the invention has been described hereinbefore with reference to an exemplary embodiment as shown in the drawings, it is to be understood that this embodiment is in no way limiting and that various modifications will offer themselves readily to those skilled in the art, such modifications being intended to be included in the scope of the appended claims which is to be considered the sole measure of the protection sought for the invention.

I claim:

1. A breathing apparatus, comprising wall means forming a larger outer mask dimensioned to fit over the face of a user, and a smaller inner mask dimensioned to cover only the external respiratory organs of the user and to subdivide the space within the outer mask into an inner chamber adapted to communicate with the external respiratory organs, and an outer chamber about said inner chamber and adapted to be at super-atmospheric pressure; control means operative for communicating said chambers with one another in response to suction created by inhaling so that the inhaled air from said inner chamber is replenished by air entering from said outer chamber and for interrupting such communication in response to pressure created in said inner chamber by exhaling; demand-valve means for admitting air into said outer chamber in response to a pressure drop in said outer chamber which results upon communication of said outer chamber with said inner chamber; and venting means for venting exhaled air from said inner chamber to the ambient atmosphere; said control means comprising at least one control valve in said wall means between said inner and outer chambers, including a valve member movable between an open and a closed position and means urging said valve member to said closed position with a force exceeding substantially the force applied to said valve member by said super-atmospheric pressure present in said outer chamber, so that the user is required to exert only the normal inhaling pressure drop when breathing in for opening said control valve, said control valve closing immediately upon exhaling so that the user is required to overcome only the normal exhaling resistance of said venting means.

2. A breathing apparatus as defined in claim 1, wherein said means urging said valve member to said closed position comprises a biasing spring; the biasing force urging said valve member to said closed position exceeding the force acting in said outer chamber upon said valve member, which is a product of the super-atmospheric pressure in said outer chamber times the surface area of said valve member.

3. A breathing apparatus as defined in claim 1, said wall means including a first wall forming said outer mask and a second wall forming said inner mask and having a peripheral edge portion which tapers toward a free edge thereof.

4. A breathing apparatus as defined in claim 1, and further comprising means for supplying breathing air at super-atmospheric pressure to said demand-valve means.

5. A breathing apparatus as defined in claim 1, wherein said means urging said valve member to said closed position comprises a biasing spring, the biasing force urging said valve member to said closed position exceeding the force acting in said outer chamber upon said valve member, which is a product of the super-atmospheric pressure in said outer chamber times the surface area of said valve member; said wall means including a first wall forming said outer mask and a second wall forming said inner mask and having a peripheral edge portion tapering toward a free edge thereof; and means for supplying breathing air at super-atmospheric pressure to said demand-valve means.

6. A method of supplying breathing air to a user wearing a breathing apparatus having a mask which forms a larger outer chamber surrounding the user's face and a smaller inner chamber within the outer chamber and surrounding only the user's external respiratory organs, comprising the steps of normally maintaining the outer chamber at super-atmospheric pressure; establishing communication between said chambers in response to suction created in said inner chamber due to inhaling by the user, so that the inhaled air of the inner chamber is replenished by air flowing from said outer chamber into said inner chamber, with a concomitant pressure drop in said outer chamber; admitting fresh air at super-atmospheric pressure into said outer chamber in response to said pressure drop; interrupting the communication between said chambers in response to pressure created in said inner chamber due to exhaling by the user; venting the exhaled air from said inner chamber to the ambient atmosphere; said step of establishing communication between said chambers comprising further urging a valve member between said chambers to a closed position with a force exceeding substantially the force applied to said valve member by said super-atmospheric pressure present in said outer chamber, so that the user is required to exert only the normal inhaling pressure drop when breathing in for opening said control valve, said control valve closing immediately upon exhaling so that the user is required to overcome only the normal exhaling resistance of venting means used for venting the exhaled air from said inner chamber to the ambient atmosphere.

* * * * *